US009508459B2

(12) United States Patent
Kitagawa et al.

(10) Patent No.: US 9,508,459 B2
(45) Date of Patent: Nov. 29, 2016

(54) METHOD TO PREVENT STRESS CORROSION CRACKING OF STORAGE CANISTER AND STORAGE CANISTER

(71) Applicants: HITACHI ZOSEN CORPORATION, Osaka (JP); CENTRAL RESEARCH INSTITUTE OF ELECTRIC POWER INDUSTRY, Tokyo (JP)

(72) Inventors: Akikazu Kitagawa, Osaka (JP); Akio Ohiwa, Osaka (JP); Keisuke Okada, Osaka (JP); Katsunori Kusunoki, Osaka (JP); Tomohiro Tanaka, Osaka (JP); Akihito Gohda, Osaka (JP); Yasuhiro Fukai, Osaka (JP); Masanori Goto, Osaka (JP); Koji Shirai, Chiba (JP)

(73) Assignees: HITACHI ZOSEN CORPORATION, Osaka (JP); CENTRAL RESEARCH INSTITUTE OF ELECTRIC POWER INDUSTRY, Tokyo (JP)

( * ) Notice: Subject to any disclaimer, the term of this patent is extended or adjusted under 35 U.S.C. 154(b) by 0 days.

(21) Appl. No.: 14/777,856

(22) PCT Filed: Mar. 7, 2014

(86) PCT No.: PCT/JP2014/055892
§ 371 (c)(1),
(2) Date: Sep. 17, 2015

(87) PCT Pub. No.: WO2014/148275
PCT Pub. Date: Sep. 25, 2014

(65) Prior Publication Data

US 2016/0240275 A1 Aug. 18, 2016

(30) Foreign Application Priority Data

Mar. 19, 2013 (JP) ..... 2013 056020

(51) Int. Cl.
*G21F 5/00* (2006.01)
(Continued)

(52) U.S. Cl.
CPC ..... *G21F 5/12* (2013.01); *B65D 53/06* (2013.01); *G21F 5/00* (2013.01); *G21F 5/008* (2013.01);
(Continued)

(58) Field of Classification Search
USPC ..... 250/505.1, 506.1, 507.1, 515.1
See application file for complete search history.

(56) References Cited

FOREIGN PATENT DOCUMENTS

| | | | |
|---|---|---|---|
| JP | 54-133442 A | 10/1979 | ..... B23K 31/06 |
| JP | 2001-170823 A | 6/2001 | ..... B23P 6/00 |
| JP | 2005-134173 A | 5/2005 | ..... G21C 19/32 |

OTHER PUBLICATIONS

International Search Report issued in corresponding International Patent Application No. PCT/JP2014/055892.
(Continued)

*Primary Examiner* — Nicole Ippolito
*Assistant Examiner* — Hanway Chang
(74) *Attorney, Agent, or Firm* — Kusner & Jaffe

(57) ABSTRACT

A method to prevent stress corrosion cracking of a storage canister 1, wherein stress corrosion cracking is prevented by applying a compressive stress to a range where a tensile residual stress is generated on a metallic body 2 by welding a cover 4 to a top 2*a* of the body 2. A first compressive stress is applied beforehand to a range L of the body 2 where a tensile residual stress is expected to be generated by the welding of the cover 4, the tensile residual stress is canceled by welding the cover 4 with a compressive residual stress generated in the range L, and then a second compressive stress is applied so as to generate a compressive residual stress over the range L.

6 Claims, 11 Drawing Sheets

(51) Int. Cl.

| | |
|---|---|
| ***G21F 5/12*** | (2006.01) |
| ***G21F 9/36*** | (2006.01) |
| ***G21F 5/008*** | (2006.01) |
| ***B65D 53/06*** | (2006.01) |
| *G21F 7/015* | (2006.01) |

(52) U.S. Cl.
CPC ..... *G21F 9/36* (2013.01); *G21F 7/015* (2013.01); *G21Y 2002/60* (2013.01); *G21Y 2004/601* (2013.01)

(56) References Cited

OTHER PUBLICATIONS

Criepi Research Report, N12023, Masanori GOTO, "Study on Interim Storage of Spent Nuclear Fuel by Concrete Cask for Practical Use: Feasibility Study on Prevention of Chloride Induced Stress Corrosion Cracking for Type 304L, 316L Stainless Steel Canister," (May 2013).

Criepi Research Report, N10035, Shirai et al., "Study on Interim Storage of Spent Nuclear Fuel by Concrete Cask for Practice Use: Feasibility Study on Prevention of Chloride Induced Stress Corrosion Cracking for Type 304L Stainless Steel Canister," (May 2011).

METHOD TO PREVENT STRESS CORROSION CRACKING OF STORAGE CANISTER AND STORAGE CANISTER

FIELD OF THE INVENTION

The present invention relates to a storage canister that seals stored nuclear fuel as radioactive waste and is installed in a nuclear waste storage facility, and a method to prevent stress corrosion cracking of the storage canister.

BACKGROUND OF THE INVENTION

Nuclear fuel as radioactive waste is stored in a storage canister in a nuclear facility of a nuclear power plant and so on. The nuclear fuel is transported from the storage canister to a nuclear waste storage facility 100 in FIG. 1 so as to be stored for an extended period. In the storage facility 100, a cask 101 contains a storage canister 102. There is a concern that the metallic storage canister 102 may have stress corrosion cracking. The storage canister 102 may have stress corrosion cracking if a tensile stress remains on an austenitic stainless steel material constituting the storage canister 102 in a corrosive environment of sea salt or the like. As shown in FIG. 1, vent holes 101*a* and 101*b* are formed at the top and bottom of the cask 101 so as to dissipate heat, which is generated by the nuclear fuel, from the surface of the storage canister 102. Since the outside air is passed through the vent holes 101*a* and 101*b*, the storage canister 102 is kept exposed to the outside air. In Japan, the nuclear waste storage facility 100 is built in a coastal region and thus cannot avoid a corrosive environment of sea salt and so on.

A tensile stress remaining on the storage canister 102 is a tensile residual stress that occurs when a cover is welded to a body constituting the storage canister 102. In a known technique, stress corrosion cracking is prevented by performing plastic working after welding so as to eliminate a tensile stress remaining on the storage canister 102 and generate a compressive residual stress (See Non Patent Literature 1). In this technique, for example, the cover is welded to the body of the storage canister 102 and then an operation is performed to apply a compressive stress to and near a welded part. More specifically, nuclear fuel is supplied into the body of the storage canister 102 in a nuclear power plant, a primary cover is welded, and then a secondary cover is welded to seal the nuclear fuel. A tensile residual stress is generated by welding on the top and covers of the body of the storage canister 102 that contains the nuclear fuel. The welded part undergoes plastic working in which a compressive stress is applied by, for example, peening. This eliminates the tensile residual stress and leaves the compressive stress over the outer surface of the storage canister 102. In domestic storage of nuclear fuel, the state of the storage canister 102 is a required condition for preventing stress corrosion cracking.

The sealed storage canister 102 that contains nuclear fuel does not leak a radioactive material to the outside but allows external leakage of radiation through the thin body of the storage canister 102. In order to prevent stress corrosion cracking of the storage canister 102, plastic working needs to be performed so as to face the storage canister 102, leading to an adverse effect of radiation leaking from the storage canister 102.

CITATION LIST

Non Patent Literature

Non Patent Literature 1: Study on interim storage of spent nuclear fuel by concrete cask for practical use, Research Report N10035, issued and reported by the Central Research Institute of Electric Power Industry in May 2011

SUMMARY OF THE INVENTION

Technical Problem

The storage canister 102 containing nuclear fuel is transported to a nuclear storage facility while being placed in a thick transport cask. In order to suppress the influence of radiation, the storage canister 102 is placed into the transport cask in a pool, and then plastic working for preventing stress corrosion cracking is performed using a space near the upper opening of the storage canister 102. Welding on the cover generates a residual tensile stress over a relatively deep range from the upper end to the bottom of the body. This requires work to a deep position from the upper opening. For example, if the top of the transport cask is further opened, an amount of exposure may disadvantageously increase.

In view of the problem of the related art, an object of the present invention is to provide a method to prevent stress corrosion cracking of a storage canister and the storage canister so as to generate a compressive residual stress over the outer surface of the storage canister while blocking radiation from nuclear fuel.

Solution to Problem

In order to generate a compressive residual stress over the outer surface of a storage canister while suppressing the influence of radiation, the inventors have focused on the significance of work with a small upper opening between the storage canister and a transport cask and reached the following technical solution:

A method to prevent stress corrosion cracking of a storage canister according to the present invention is a method to prevent stress corrosion cracking of a storage canister by applying a compressive stress to a range where a tensile residual stress is generated on a metallic cylindrical body by welding a cover to the top of the cylindrical body, the method including: applying a first compressive stress beforehand to the range of the cylindrical body where the tensile residual stress is expected to be generated by the welding of the cover; canceling the tensile residual stress generated by the welding of the cover, with a compressive residual stress generated in the range; and then applying a second compressive stress so as to generate a compressive residual stress over the range.

According to the present invention, the first compressive stress is applied beforehand to the range of the body where the tensile residual stress is expected to be generated by the welding of the cover. This cancels the tensile residual stress generated by the welding and reduces a work range of application of the second compressive stress, accordingly. Thus, work can be performed with a small upper opening between the storage canister and a transport cask, thereby generating a compressive residual stress over the outer surface of the cylindrical body.

The range of the cylindrical body that receives the first compressive stress is an axial range extending inward from the upper end of the cylindrical body in the axial direction, the axial range L satisfying the relational expression below:

$$L \geq 2.5\sqrt{rt}$$

(r: the external radius of the cylindrical body, t: the thickness of the cylindrical body).

The axial range of the cylindrical body where a tensile residual stress is generated by welding of the cover is indicated by the right side of the relational expression. Thus, if the axial range for applying the first compressive stress satisfies the expression, a compressive residual stress can be generated over the outer surface of the cylindrical body.

The first compressive stress can be applied by various working methods. For example, zirconia shot peening or burnishing is preferably used.

A storage canister according to the present invention is a storage canister including a metallic cylindrical body with a cover welded to the top of the cylindrical body, the storage canister being installed in a cask while containing nuclear fuel in a sealing state, wherein a first compressive stress is applied beforehand to a range of the cylindrical body where a tensile residual stress is expected to be generated by the welding of the cover, the tensile residual stress generated by the welding of the cover is canceled with a compressive residual stress generated in the range, and then a second compressive stress is applied so as to generate a compressive residual stress over the range.

According to the present invention, the first compressive stress is applied beforehand to the range of the cylindrical body where a tensile residual stress is expected to be generated by welding the cover. This cancels the tensile residual stress generated by welding and reduces the work range of application of the second compressive stress, enabling work with a small upper opening between the storage canister and the transport cask and generation of a compressive residual stress over the outer surface of the cylindrical body.

The storage canister may enable work for applying the second compressive stress to an upper opening between the cask and the cylindrical body.

Specifically, if the cover includes an upper cover welded to the upper end of the cylindrical body and a lower cover welded to the cylindrical body inside the upper cover, the lower cover may be welded at a position in an axial range from the upper end of the cylindrical body to an L minimum value indicated by the right side of the relational expression.

Advantageous Effect of Invention

As has been discussed, according to the present invention, a tensile residual stress generated by welding is canceled. This reduces a work range for applying a second compressive stress, enabling work with a small upper opening between a storage canister and a transport cask. Thus, a compressive residual stress can be generated over the outer surface of a cylindrical body while radiation from nuclear fuel is blocked.

DETAILED DESCRIPTION OF THE PREFERRED EMBODIMENT

Figure 1:
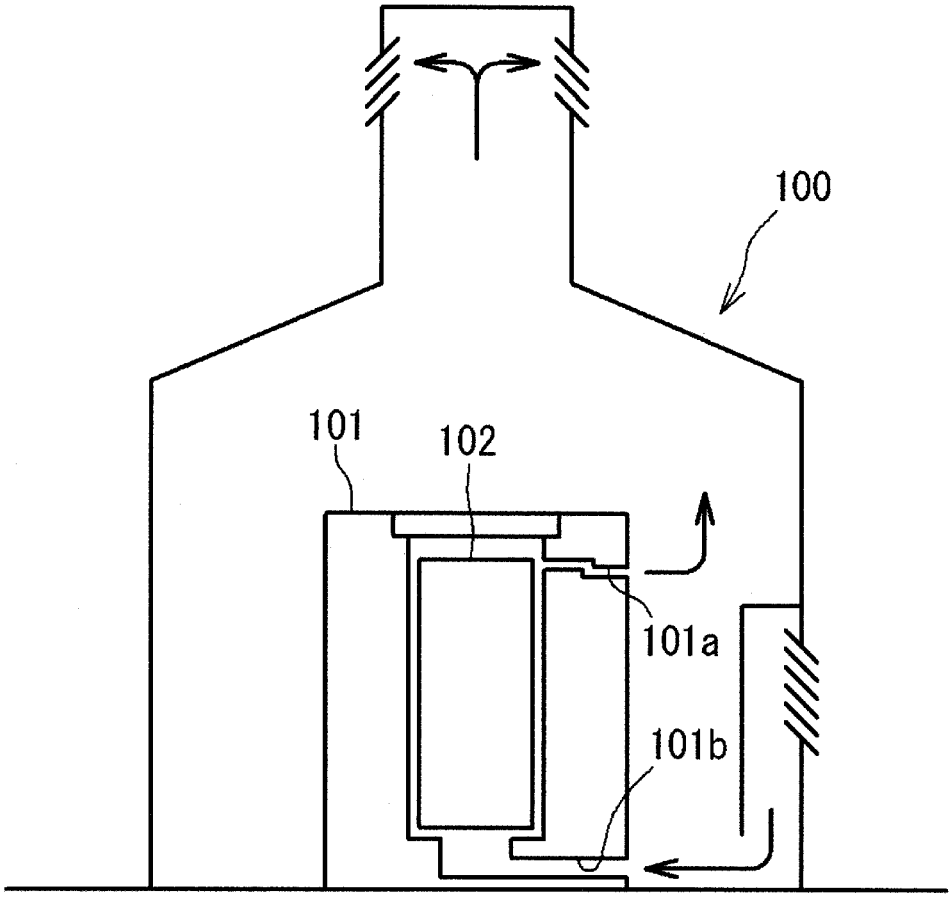
FIG. 1 PRIOR ART
FIG. 1 is a schematic diagram of a nuclear storage facility.
Figure 2:
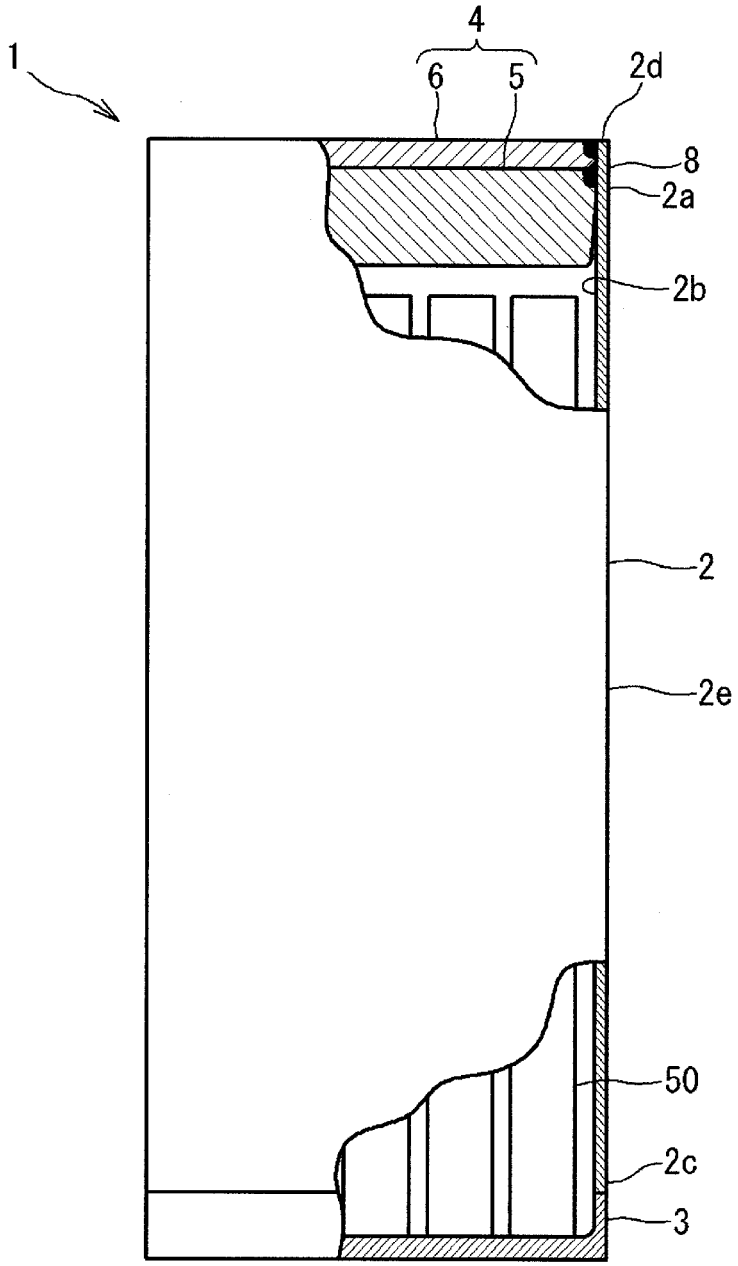
FIG. 2 is a side view showing a storage canister according to an embodiment of the present invention.

An embodiment of the present invention will be described below with reference to the accompanying drawings. FIG. 2 is a side view of a storage canister 1 according to the embodiment of the present invention. The storage canister 1 stores spent nuclear fuel 50. The stored spent nuclear fuel 50 is installed in a nuclear storage facility. The storage canister 1 is made of austenitic stainless steel and includes a long cylindrical body 2 (cylindrical body), a bottom member 3 that closes the bottom of the body 2, and a cover 4 that closes a top 2*a* of the body 2. The bottom member 3 and the cover 4 are welded to the body 2, sealing the storage canister 1 so as to prevent leakage of a radioactive material. Generally, the body 2 of the storage canister 1 is about 1700 mm in outside diameter, about 4600 mm in height, and about 13 mm in thickness.

The cover 4 of the present embodiment includes an inner primary cover member 5 (lower cover) and an outer secondary cover member 6 (upper cover). The number of cover members constituting the cover that seals the body 2 is not limited and thus one or at least three cover members may be used. The edge of the primary cover member 5 and an inner surface 2*b* of the body 2 are welded to each other; meanwhile, the edge of the secondary cover member 6 and the inner surface 2*b* of the body 2 are welded to each other. The bottom member 3 is welded to a lower end 2*c* of the body 2.

Figure 3:
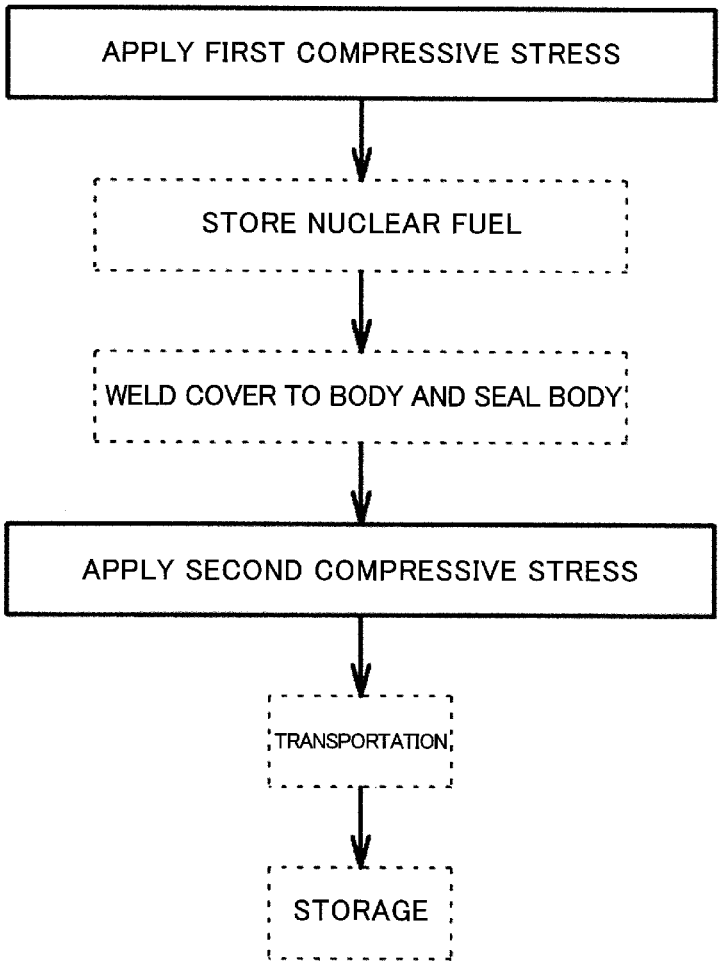
FIG. 3 is a flowchart for explaining the steps of a method to prevent stress corrosion cracking of the storage canister.

FIG. 3 is a flowchart for explaining the steps of a method to prevent stress corrosion cracking of the storage canister 1. In the method to prevent stress corrosion cracking of the storage canister according to the present embodiment (hereinafter, will be referred to as a method to prevent stress corrosion cracking), stress corrosion cracking is prevented by a residual compressive stress. A first compressive stress is applied beforehand to an axial range of the body 2 where a tensile residual stress is expected to be generated by welding of the cover 4, the cover 4 is welded with the compressive stress in the axial range so as to cancel the tensile residual stress, and then a second compressive stress is applied. Specifically, the first compressive stress is applied to the body 2, spent nuclear fuel is accommodated in the closed-end body 2 installed in a transport cask in a pool, and then the cover 4 is automatically welded to the body 2 to seal the body 2. In this state, the second compressive stress is applied to the top of the body 2. After that, the transport cask is transported with the storage canister 1 to a nuclear storage facility so as to store the spent nuclear fuel.

Figure 4:
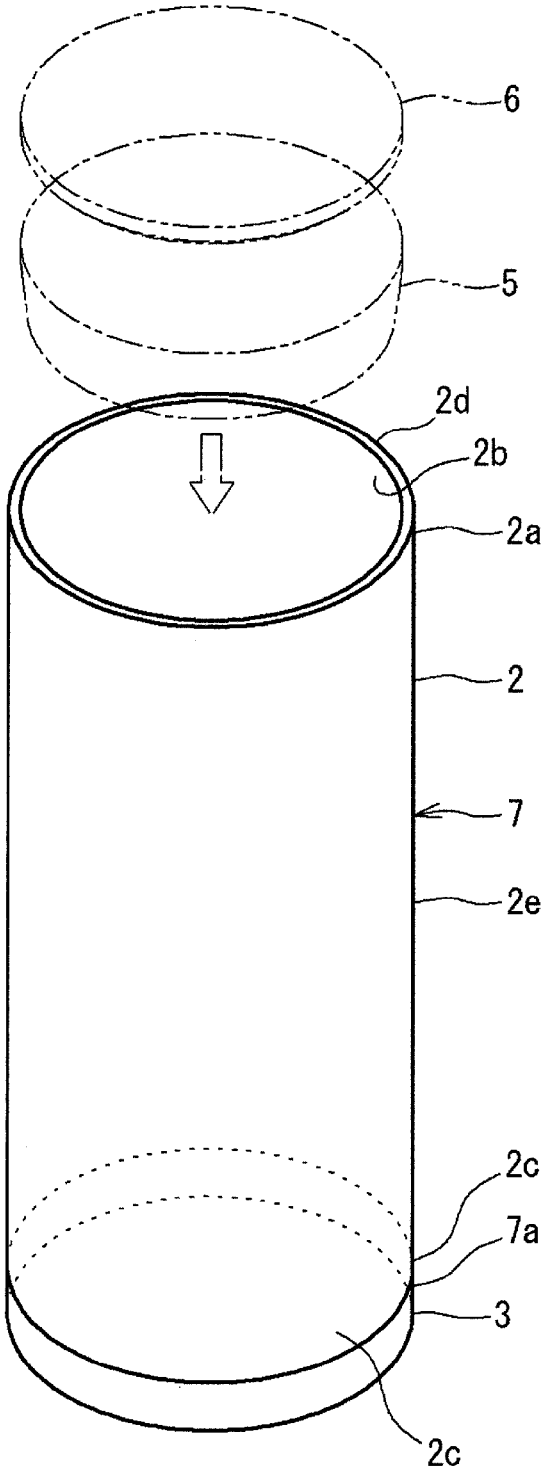
FIG. 4 is a perspective view of a body having a bottom member.

The steps will be sequentially described below. First, the bottom member 3 is welded to the cylindrical body 2 to form a closed-end cylindrical body 7 shown in FIG. 4. A tensile residual stress generated by welding remains in a bottom 7*a* of the closed-end cylindrical body 7. Thus, plastic working is performed using, for example, shot peening to eliminate the tensile residual stress and leave a compressive stress. This can prevent stress corrosion cracking of the bottom 7*a*. In this working, nuclear fuel is not stored and no structure surrounds the body 2, thereby obtaining a sufficient working space without radiation exposure.

Figure 5:
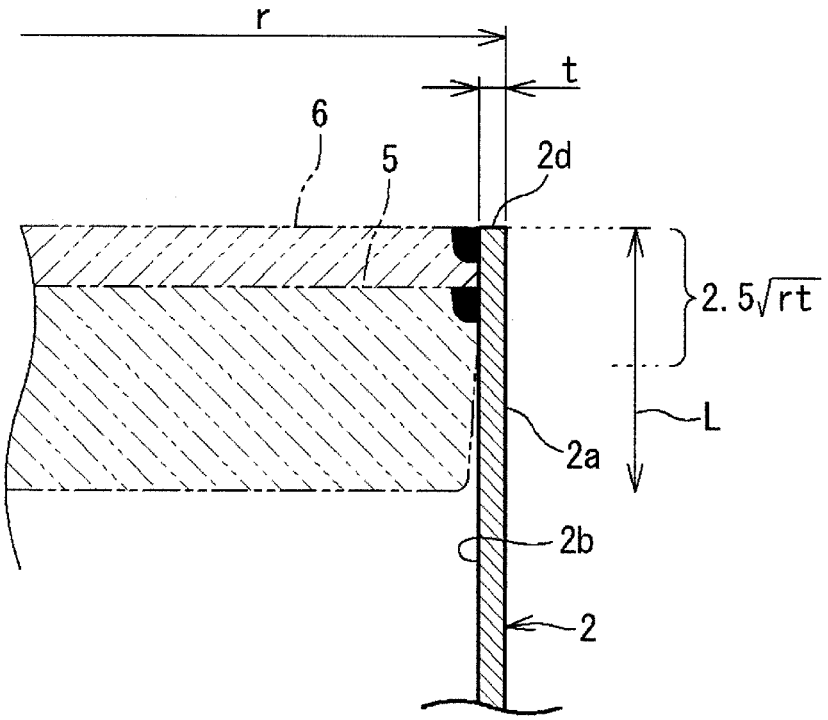
FIG. 5 is an enlarged view at and near the welded part of the body.

FIG. 5 is an enlarged view at and near the welded part of the body 2. Before the cover members 5 and 6 are welded, work for applying the first compressive stress is performed beforehand in the range of the body 2 where a tensile residual stress is expected to be generated by welding. A range L in the top 2*a* of the body 2 where the first compressive stress is applied is an axial range that is extended inward from an upper end 2*d* of the body 2 in the axial direction. The range L satisfies a relational expression shown below. Thus, the axial range L where the first compressive stress is applied needs to extend from the upper end 2*d* of the body 2 at least to a minimum value of L (hereinafter, will be referred to as an L minimum value) which is expressed by the right side of the relational expression. The L minimum value is about 300 mm in the typical storage canister 1.

$$L \geq 2.5\sqrt{rt}$$

(r: the external radius of the cylindrical body, t: the thickness of the cylindrical body)

Figure 6A:
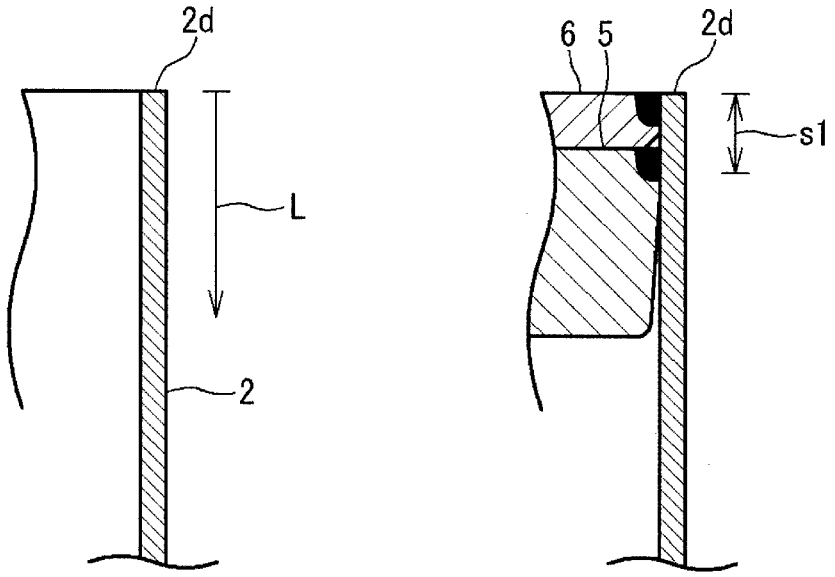
FIG. 6(*a*) is an explanatory drawing of the concept of the present invention, and FIG. 6(*b*) is an explanatory drawing of the related art corresponding to the present invention.
Figure 6B:
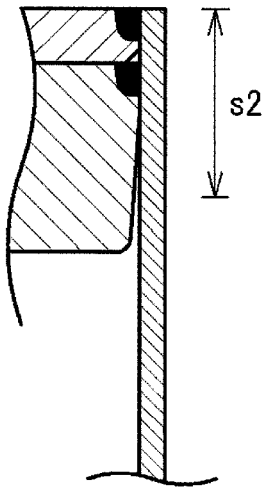
FIG. 6(B) PRIOR ART

FIG. 6(*a*) is an explanatory drawing of the concept of the method to prevent stress corrosion cracking according to the present invention. FIG. 6(*b*) is an explanatory drawing of the related art corresponding to the present invention. The axial range of a tensile residual stress generated by welding of the secondary cover member 6 extends from the upper end 2*d* of the body 2 to the L minimum value. Thus, the first compressive stress is applied beforehand at least to the range to generate a compressive residual stress, thereby canceling the tensile residual stress generated during welding. Since the upper end 2*d* of the body 2 and a range s1 near the upper end 2*d* are substantially melted during welding, the applied compressive residual stress is also eliminated only in the axial range s1. Hence, in the step of applying the second compressive stress, a compressive residual stress can be generated over the outer surface of the body 2 only by processing the narrow axial range s1. This can apply the second compressive stress at a smaller depth (axial range s1) than a conventional depth s2. Moreover, a compressive residual stress may be applied beforehand by some method to a part other than the L range where the first compressive stress is not applied.

In the present embodiment, the inner primary cover member 5 is welded to the body 2, and then the outer secondary cover member 6 is welded to the body 2. Welding of the secondary cover member 6 generates a tensile residual stress in the axial range from the upper end 2*d* of the body 2 to the L minimum value. Similarly, a tensile residual stress is also generated by welding of the primary cover member 5. The primary cover member 5 only needs to be welded at a position in the axial range from the upper end 2*d* of the body 2 to the L minimum value. The outer end of the axial range L where the first compressive stress is applied is the upper end 2*d* of the body 2. This configuration cancels the tensile residual stress generated by welding of the primary and secondary cover members 5 and 6.

As has been discussed, a tensile residual stress is generated in the range from the upper end 2*d* of the body 2 to the L minimum value and thus a first compressive stress P1 needs to be applied to this range. The axial range L where the first compressive stress P1 is applied may be extended from the upper end 2*d* to the lower end 2*c* of the body 2 or to an axial central part 2*e*. The axial range L is preferably extended to the L minimum value+about 100 mm inward or more preferably to the L minimum value+about 50 mm inward in view of working. Plastic working for applying the first compressive stress P1 is performed up to the L minimum value+about 100 mm, thereby more reliably canceling the tensile residual stress generated by welding.

Figure 7:
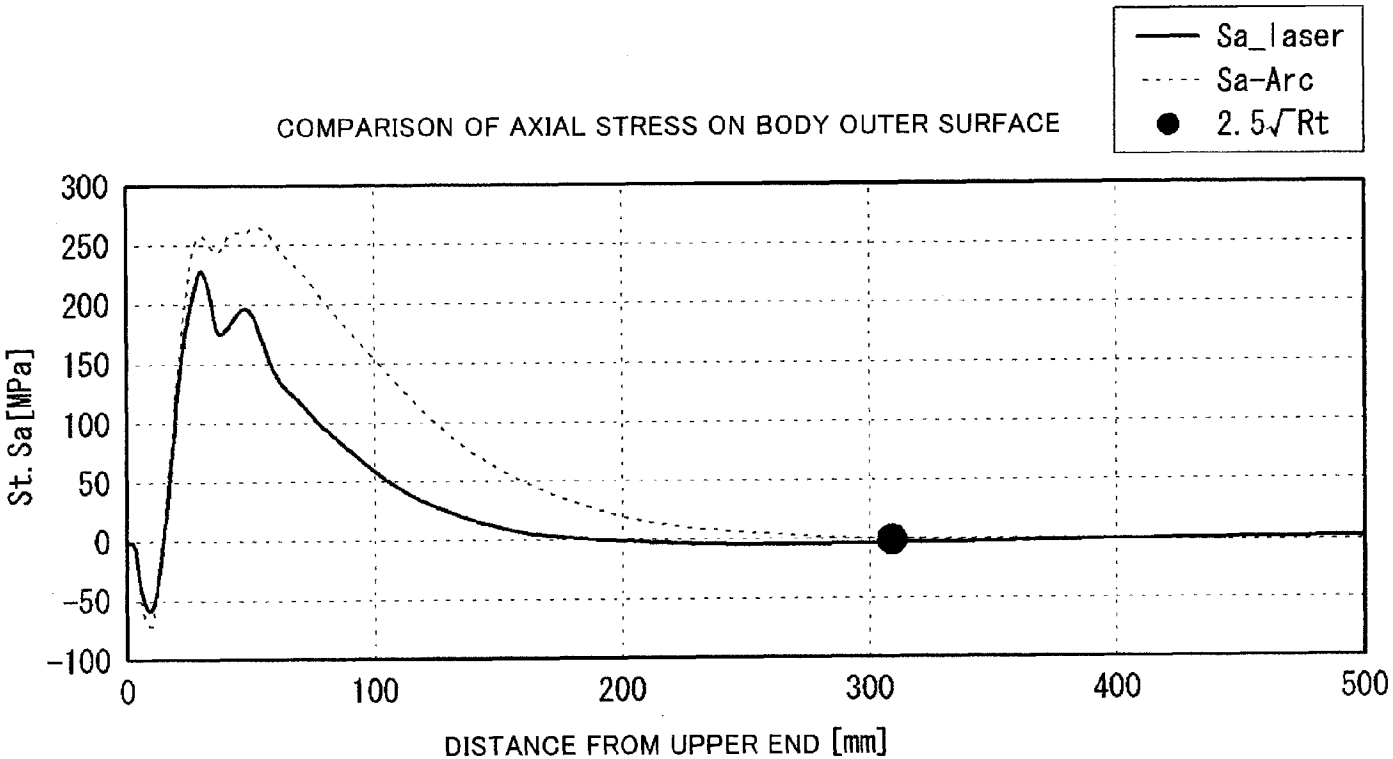
FIG. 7 is a graph showing an axial residual stress generated on the outer surface of the body by laser welding and arc welding.

A tensile residual stress is also generated on the cover members 5 and 6 by welding. The outer secondary cover member 6 is unfortunately exposed to the outside air. The secondary cover member 6 may also similarly undergo plastic working for applying the first compressive stress. The transport cask with an opened upper end does not interfere with a working space and thus the first compressive stress does not always need to be applied to the cover 4. A welding method for the body 2 and the cover 4 is preferably, but not exclusively, laser welding or arc welding. FIG. 7 is a graph showing an axial residual stress on the outer surface of the body during welding of the welding method. The region of a tensile residual stress is larger in arc welding than in laser welding, proving that laser welding is more preferable.

Plastic working for applying the first compressive stress and the second compressive stress will be described below. A compressive residual stress already generated on an austenitic stainless steel material by scaling has a maximum depth of about 200 μm, requiring plastic working for applying the first compressive stress and the second compressive stress. For example, plastic working for applying a compressive stress includes, but not exclusively, peening methods such as laser peening, water jet peening, and shot peening. Laser peening and water jet peening with low workability and high construction cost are not generally used. Known shot peening methods include, for example, cast steel shot, alumina shot, and zirconia shot. In cast steel shot, there is a concern that a compressed layer having a depth of, for example, about 0.4 mm may cause red rust. In alumina shot, a rough surface is not disadvantageous but a compressed layer is about 0.5 mm in depth, generating a compressive residual stress at a relatively small depth as in cast steel shot.

In zirconia shot, zirconia has high toughness and a compressed layer is about 0.7 mm in depth, thereby generating a compressive residual stress at a larger depth. In the present embodiment, zirconia shot is used to emit zirconia particles having a diameter of 1.0 μm with an air pressure of 5 $kg/cm^2G$ and a coverage of 3. The compressed layer has a depth of 0.7 mm. In the three shot patterns, zirconia shot is the most suitable.

Burnishing is another known plastic working method for applying a compressive stress. Burnishing is plastic working in which a pressing tool with a hard spherical member attached to one end of the tool is rolled in contact with the surface of a target material. This method can obtain a deep compressed layer without generating dust and thus is the most suitable for working in a nuclear power generation facility. In various peening methods, a processed surface has a satin finish, whereas in burnishing, a processed surface has a mirror finish. Thus, any one of these methods allows simple visual confirmation of a worked range, achieving higher workability.

Figure 8:
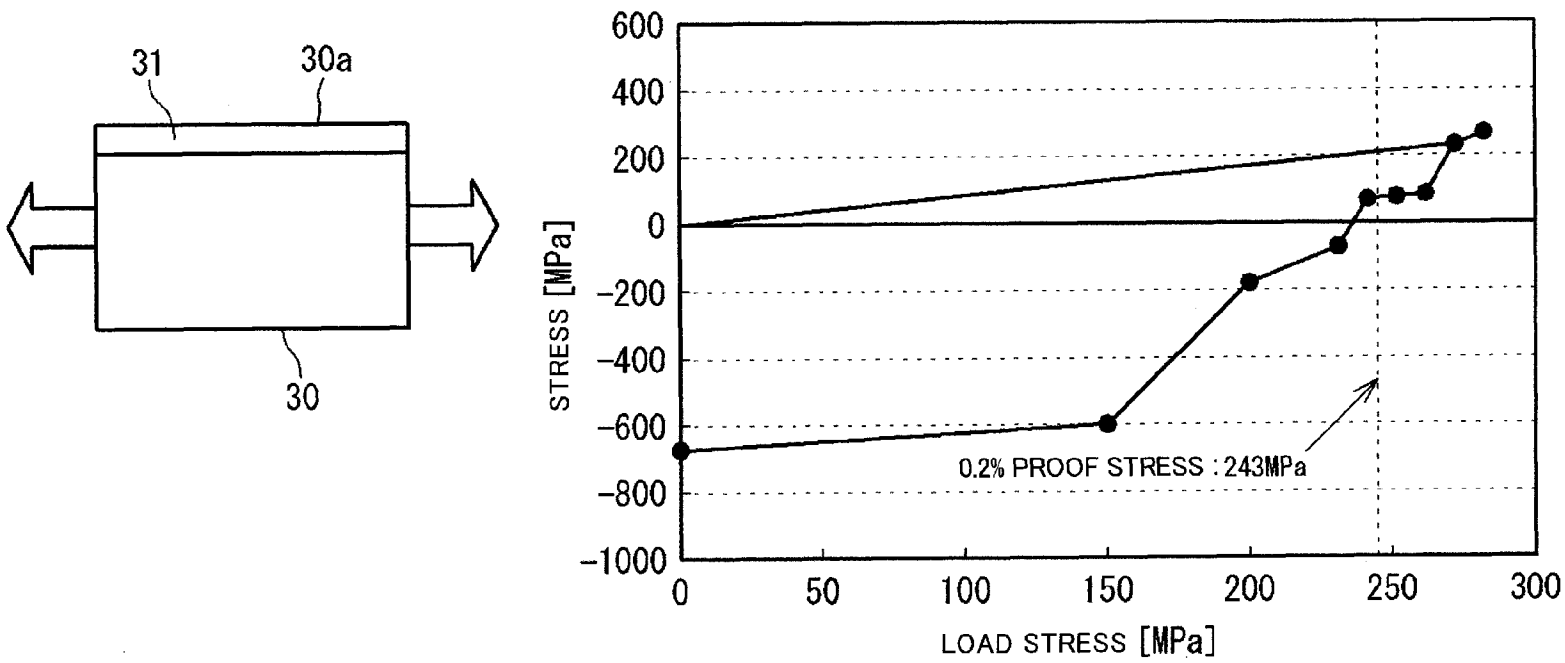
FIG. 8 is an explanatory drawing showing a change of a residual stress value when a tensile stress is applied to a compressive stress processing part.

FIG. 8 is an explanatory drawing showing a change of a residual stress value when a tensile stress is applied to the compressive stress processing part of an austenitic stainless steel material. Peening of zirconia shot was performed on one surface 30*a* of an austenitic stainless steel material 30 having predetermined dimensions. A tensile load was then laterally applied to the surface; meanwhile, a change of a residual stress value of a peening portion 31 was measured. FIG. 8 is a graph of measurement results. A vertical chain line in the graph indicates 243 MPa with a proof stress of 0.2%. The peening portion 31 has a residual stress value of "compression" up to a proof stress of 0.2%. Thus, even in the application of a tensile load, the peening portion 31 has a residual stress on a compression side up to a proof stress of 0.2%. The storage canister 1 designed with one third of the 0.2% proof stress does not eliminate an applied compressive residual stress.

Since a nuclear fuel storage facility is built in a coastal region, the storage canister 1 in the cask is always exposed to a salt atmosphere. The existence of a compressive residual stress can prevent stress corrosion cracking but corrosion caused by salt also needs to be taken into consideration. If salt causes corrosion deeper than a compressive residual stress layer, stress corrosion cracking may occur. Thus, a maximum corrosion depth was estimated at a relative humidity of 15% (room temperature) close to a coastal environmental condition. An estimated value was calculated on the assumption that corrosion linearly grows with a maximum corrosion depth of 1000 hours. A total amount of time when stress corrosion cracking is likely to grow is 3853 hours in a northern part of the Honshu island and 15021 hours on a central coast of the Japan Sea according to the temperature of the storage canister and weather data, which is cited from "Study on interim storage of spent nuclear fuel by concrete cask for practical use, Research Report N10035, issued and reported by the Central Research Institute of Electric Power Industry in May 2011 (Non Patent Literature 1)".

The estimated value of the maximum corrosion depth will be shown below.

(Grinding)

SUS304L: 161 μm (a northern part of the Honshu island), 625 μm (a central coast of the Japan Sea)

SUS316L: 213 μm (a northern part of the Honshu island), 829 μm (a central coast of the Japan Sea)

(Peening)

SUS304L: 114 μm (a northern part of the Honshu island), 442 μm (a central coast of the Japan Sea)

SUS316L: 182 μm (a northern part of the Honshu island), 706 μm (a central coast of the Japan Sea)

(Burnishing)

SUS316L: 215 μm (a northern part of the Honshu island), 838 μm (a central coast of the Japan Sea)

A compressive residual stress layer obtained by grinding has a depth of 0, a compressive residual stress layer obtained by peening of zirconia shot has a depth of 800 μm, and a compressive residual stress layer obtained by burnishing has a depth of 1500 μm.

Stress corrosion cracking does not appear under the condition of (a corrosion depth<the depth of a compressive residual stress layer). Thus, peening or burnishing is performed to form a compressive residual stress layer of about 1 mm with the application of the first compressive stress and the second compressive stress, preventing stress corrosion cracking caused by the influence of corrosion. Even if a material surface layer is slightly damaged by fretting or collision during the manufacturing of the storage canister 1, the damage has a depth of about several hundreds of μm. Forming the compressive residual stress layer of about 1 mm can prevent stress corrosion cracking caused by the influence of damage. The deeper the compressive residual stress layer, the better. However, the compressive residual stress layer has a maximum depth of about 2 mm or preferably has a depth of about 1 mm in view of workability.

The storage canister of the present invention can be obtained by performing the method to prevent stress corrosion cracking. Specifically, the storage canister 1 of the present invention includes the cover 4 welded to the top 2*a* of the metallic cylindrical body 2 and is installed in the cask while containing nuclear fuel in a sealing state. The first compressive stress is applied beforehand to the range of the body 2 where a tensile residual stress is expected to be generated by welding of the cover 4, the cover 4 is welded with a compressive residual stress in the range so as to cancel the tensile residual stress, and then the second compressive stress is applied so as to generate a compressive residual stress over the range.

Figure 9:
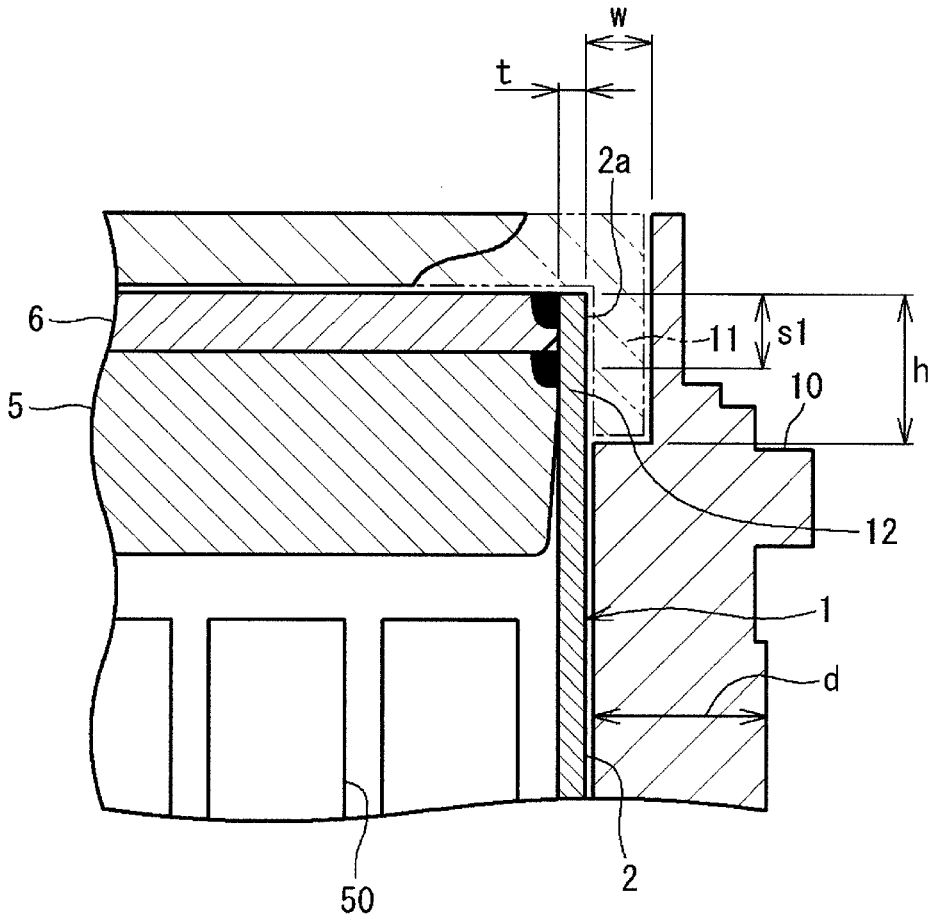
FIG. 9 is a partial enlarged view of the storage canister contained in a transport cask.

FIG. 9 is a partial enlarged view of the storage canister 1 contained in a transport cask 10. In order to suppress the influence of radiation, the storage canister 1 is placed into the transport cask 10 and then undergoes plastic working for preventing stress corrosion cracking. Conventionally, plastic working is deeply performed from the top toward the bottom of the body, whereas plastic working on the storage canister 1 of the present embodiment is limited to the small range s1 from the top 2*a* toward the bottom of the body 2. An upper opening 11 between the storage canister 1 and the transport cask 10 is sufficiently useful for a plastic working operation for applying the second compressive stress. The transport cask 10 has a thickness d of about 200 mm.

As has been discussed, the range from the upper end 2*d* of the body 2 to the L minimum value is about 300 mm in the typical storage canister 1. In the present embodiment, the upper opening 11 has a radial dimension w of about 125 mm and a depth h (axial dimension) of about 145 mm. The depth h of the upper opening 11 may be almost double the thickness t of the storage canister 1, from a lower end 12 of the welded part of the primary cover member 5 toward the bottom of the primary cover member 5. These dimensions are not limited and can be optionally changed. The formation of the storage canister 1 according to this method cancels all tensile residual stresses while blocking radiation from nuclear fuel, thereby generating a compressive residual stress over the body 2.

According to the present embodiment, the first compressive stress is applied beforehand to the range of the body 2 where a tensile residual stress is expected to be generated by welding of the cover 4. This cancels the tensile residual stress generated by welding and reduces a work range of application of the second compressive stress, accordingly. Thus, work can be performed with the small upper opening 11 between the storage canister 1 and the transport cask 10, thereby generating a compressive residual stress over the outer surface of the body 2 while blocking radiation from nuclear fuel.

The present embodiment illustrates, but not exclusively, one example of the method to prevent stress corrosion cracking of the storage canister and the storage canister according to the present invention. The method to prevent stress corrosion cracking of the storage canister may include other steps, and the shape and dimensions of the storage canister may be changed.

Referring to FIG. 9, for example, the upper opening 11 between the transport cask 10 and the storage canister 12 may be filled with water and then the cover members 5 and 6 may be welded in this state. Specifically, in the method to prevent stress corrosion cracking of the storage canister, the first compressive stress is applied beforehand to the range of the cylindrical body where a tensile residual stress is expected to be generated by welding of the covers, the covers are welded with a compressive residual stress in the range so as to cancel the tensile residual stress, and then the second compressive stress is applied so as to generate a compressive residual stress over the range. The welded part is water-cooled during the welding of the covers, further reducing the range of application of the second compressive stress.

Figure 10:
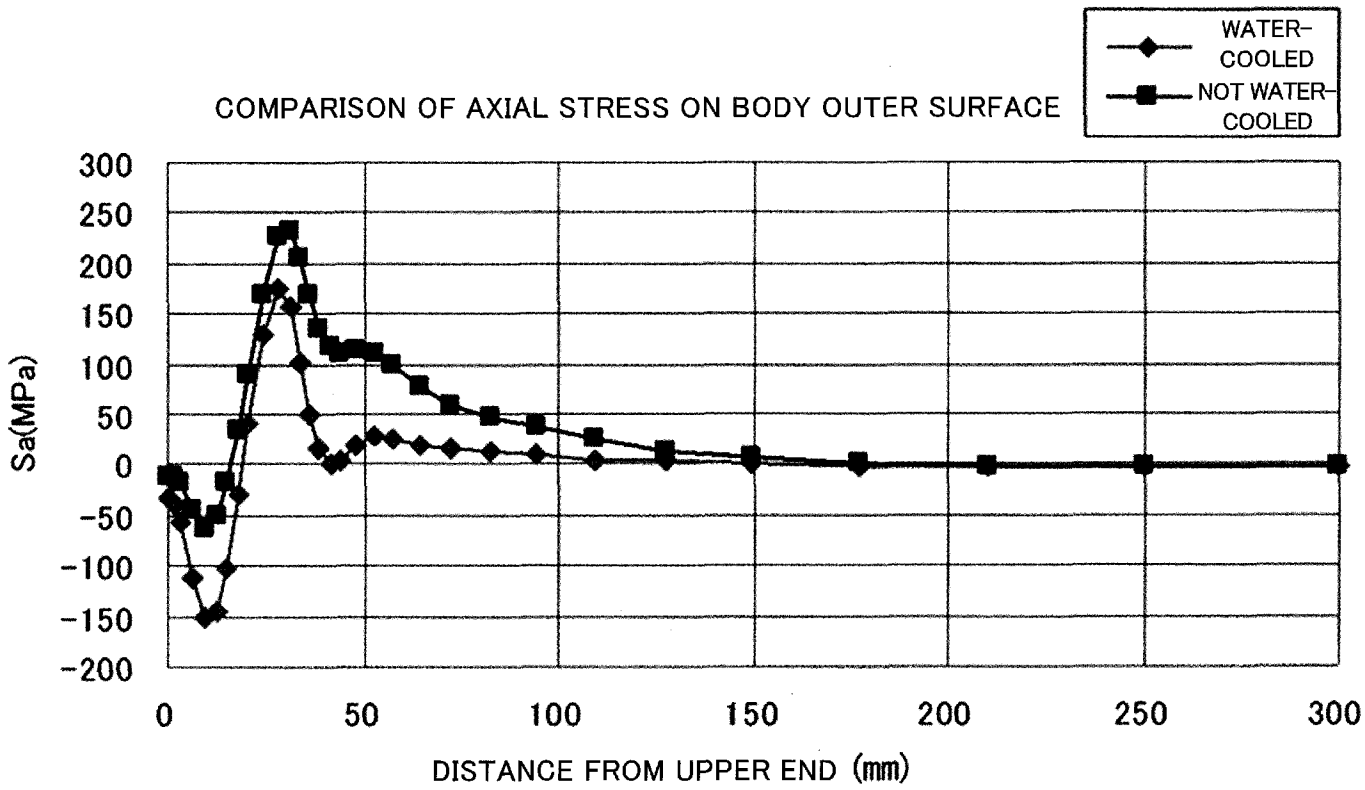
FIG. 10 is a graph showing an axial residual stress on the outer surface of the body when the welded part is water-cooled and when the welded part is not water-cooled.
Figure 11:
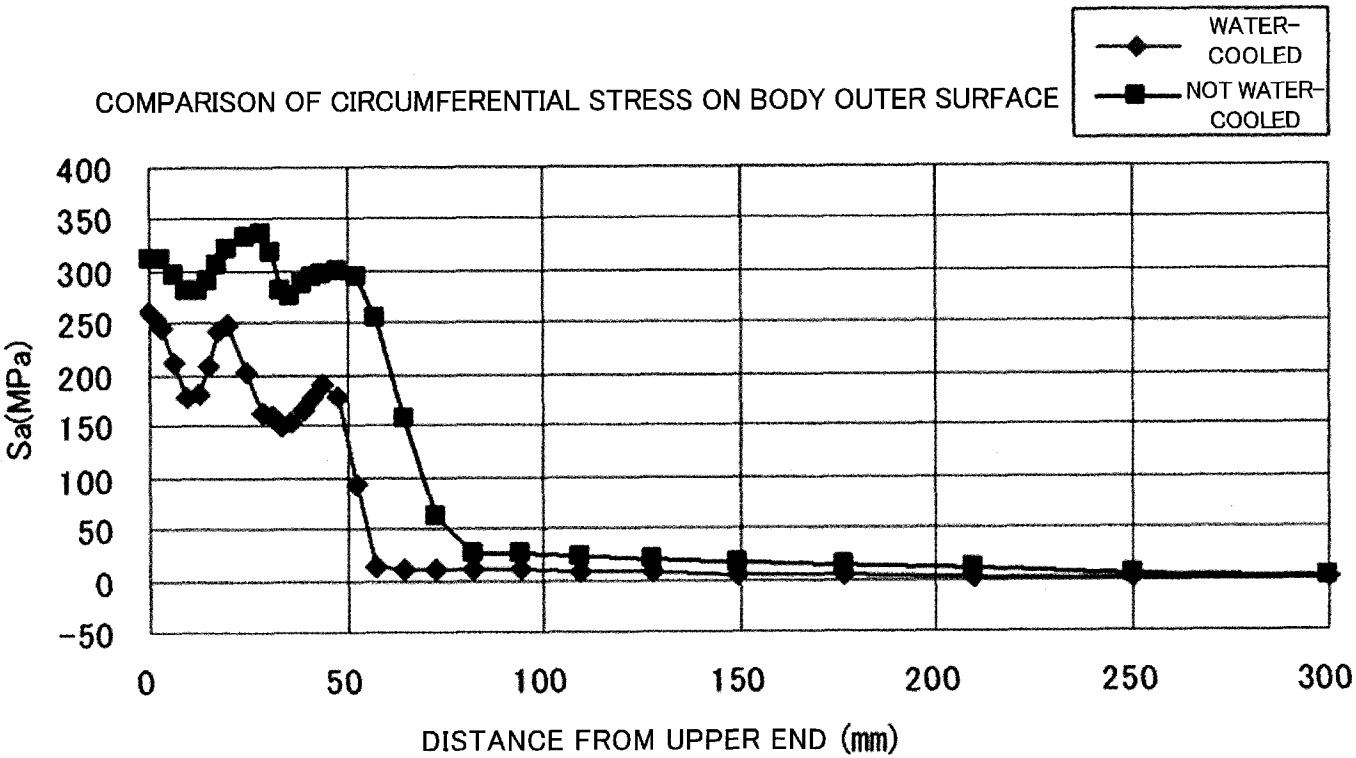
FIG. 11 is a graph showing a circumferential residual stress on the outer surface of the body when the welded part is water-cooled and when the welded part is not water-cooled.

FIG. 10 is a graph showing an axial residual stress on the outer surface of the body when the welded part is water-cooled and when the welded part is not water-cooled. FIG. 11 is a graph showing a circumferential residual stress on the outer surface of the body when the welded part is water-cooled and when the welded part is not water-cooled. As shown in FIGS. 10 and 11, a residual axial stress and a residual circumferential stress both reduce the generation region of a tensile stress. Welding during cooling suppresses the expansion of the body, further reducing the axial range where a tensile residual stress is generated after welding. This can achieve a smaller work range for applying the second compressive stress.

The invention claimed is:

1. A method to prevent stress corrosion cracking of a storage canister by applying a compressive stress to a range where a tensile residual stress is generated on a metallic cylindrical body by welding a cover to a top of the cylindrical body, the method comprising:

applying a first compressive stress beforehand to the range of the cylindrical body where the tensile residual stress is expected to be generated by the welding of the cover;

canceling the tensile residual stress generated by the welding of the cover, with a compressive residual stress generated in the range; and then applying a second compressive stress so as to generate a compressive residual stress over the range.

2. The method to prevent stress corrosion cracking of a storage canister according to claim 1, wherein the range of the cylindrical body that receives the first compressive stress is an axial range extending inward from an upper end of the cylindrical body in an axial direction, the axial range L satisfying a relational expression below:

$$L \geq 2.5\sqrt{rt}$$

(r: an external radius of the cylindrical body, t: a thickness of the cylindrical body).

3. The method to prevent stress corrosion cracking of a storage canister according to one of claims 1 and 2, wherein the first compressive stress is applied by one of zirconia shot peening and burnishing.

4. A storage canister comprising a metallic cylindrical body with a cover welded to a top of the cylindrical body, the storage canister being installed in a cask while containing nuclear fuel in a sealing state, wherein a first compressive stress is applied beforehand to a range of the cylindrical body where a tensile residual stress is expected to be generated by the welding of the cover, the tensile residual stress generated by the welding of the cover is canceled with a compressive residual stress generated in the range, and then a second compressive stress is applied so as to generate a compressive residual stress over the range.

5. The storage canister according to claim 4, wherein the second compressive stress is applied to an upper opening between the cask and the cylindrical body, allowing generation of the compressive residual stress over the range.

6. The storage canister according to claim 5, wherein the cover includes an upper cover welded to an upper end of the cylindrical body and a lower cover welded to the cylindrical body inside the upper cover, and the lower cover is welded at a position in an axial range from the upper end of the cylindrical body to an L minimum value indicated by a right side of a relational expression below:

$$L \geq 2.5\sqrt{rt}$$

(r: an external radius of the cylindrical body, t: a thickness of the cylindrical body).

* * * * *